US009302139B2

(12) United States Patent
Habing et al.

(10) Patent No.: US 9,302,139 B2
(45) Date of Patent: Apr. 5, 2016

(54) SLIDABLE BAR AND CARRIAGE EXERCISE ASSEMBLY

(71) Applicant: Dream Visions, LLC, Tustin, CA (US)

(72) Inventors: Theodore G. Habing, Tustin, CA (US); Jeff Laborde, Anaheim, CA (US)

(73) Assignee: Dream Visions, LLC, Tustin, CA (US)

( * ) Notice: Subject to any disclaimer, the term of this patent is extended or adjusted under 35 U.S.C. 154(b) by 175 days.

(21) Appl. No.: 13/915,478

(22) Filed: Jun. 11, 2013

(65) Prior Publication Data

US 2013/0274075 A1 Oct. 17, 2013

Related U.S. Application Data

(63) Continuation-in-part of application No. 13/229,175, filed on Sep. 9, 2011.

(51) Int. Cl.
*A63B 21/062* (2006.01)
*A63B 21/078* (2006.01)
(Continued)

(52) U.S. Cl.
CPC ..... *A63B 21/062* (2013.01); *A63B 21/0628* (2015.10); *A63B 21/078* (2013.01); *A63B 21/154* (2013.01); *A63B 21/156* (2013.01); *A63B 23/03525* (2013.01); *A63B 23/03541* (2013.01); *A63B 23/03566* (2013.01); *A63B 21/4033* (2015.10); *A63B 21/4035* (2015.10); *A63B 21/4043* (2015.10);
(Continued)

(58) Field of Classification Search
CPC ..... A63B 2023/0411; A63B 15/00; A63B 21/02; A63B 21/06; A63B 21/0615; A63B 21/078; A63B 21/154; A63B 21/156; A63B 21/0623; A63B 21/0613; A63B 21/0614; A63B 21/072; A63B 21/0724; A63B 21/0622; A63B 21/0642; A63B 21/0626; A63B 21/0783
See application file for complete search history.

(56) References Cited

U.S. PATENT DOCUMENTS 4,402,504 A 9/1983 Christian
5,725,459 A * 3/1998 Rexach ..... 482/92
(Continued)

FOREIGN PATENT DOCUMENTS

WO WO-2012012578 1/2012

OTHER PUBLICATIONS

Dream Visions LLC, Non-Final Office Action mailed Jun. 18, 2014, U.S. Appl. No. 13/229,175.
(Continued)

*Primary Examiner* — Oren Ginsberg
*Assistant Examiner* — Nyca T Nguyen
(74) *Attorney, Agent, or Firm* — Blakely Sokoloff Taylor & Zafman LLP

(57) ABSTRACT

An exercise apparatus includes a frame with a pair of vertical guides. A carriage is slidably carried on each of the guides. Each of the carriages has a locking mechanism to lock the carriage at a selected vertical position and a release to disengage the locking mechanism. A horizontal exercise bar is slidably carried on guide rods. First and second cables are coupled to a selectable exercise resistance, each of the cables having an end selectively coupled to either the respective carriage or to a respective bracket at the end of the exercise bar. Secondary brackets on the exercise bar are configured to engage respective ones of the carriage releases and grab the carriage so as to selectively engage and disengage the locking mechanisms upon axial rotation of the exercise bar and raise and lower the carriages with the exercise bar.

17 Claims, 13 Drawing Sheets

(51) Int. Cl.

| | |
|---|---|
| ***A63B 21/00*** | (2006.01) |
| ***A63B 23/035*** | (2006.01) |
| *A63B 23/02* | (2006.01) |
| *A63B 23/12* | (2006.01) |

(52) U.S. Cl.
CPC ..... *A63B 23/0216* (2013.01); *A63B 23/1209* (2013.01); *A63B 23/1218* (2013.01); *A63B 23/1236* (2013.01); *A63B 2225/093* (2013.01)

(56) References Cited

U.S. PATENT DOCUMENTS

| | | | | |
|---|---|---|---|---|
| 5,738,615 | A * | 4/1998 | McCollum et al. | 482/108 |
| 6,394,935 | B1 | 5/2002 | Lake | |
| 6,623,409 | B1 | 9/2003 | Abelbeck | |
| 7,455,629 | B2 * | 11/2008 | Abelbeck | 482/92 |
| 7,488,277 | B1 * | 2/2009 | Knapp | 482/104 |
| 7,520,843 | B1 * | 4/2009 | Goddard | 482/104 |
| 7,549,950 | B1 * | 6/2009 | Lundquist et al. | 482/101 |
| 7,651,443 | B1 | 1/2010 | Fenster et al. | |
| 8,047,972 | B1 * | 11/2011 | Dean et al. | 482/104 |
| 2002/0091043 | A1 * | 7/2002 | Rexach | 482/98 |
| 2007/0037674 | A1 * | 2/2007 | Finn et al. | 482/97 |
| 2012/0065035 | A1 | 3/2012 | Makula | |
| 2013/0296144 | A1 * | 11/2013 | Gvoich | 482/102 |

OTHER PUBLICATIONS

Taiwanese Office Action mailed Nov. 13, 2015, TW Appln. No. 103117024, with English-language translation, 9 pages.

* cited by examiner

SLIDABLE BAR AND CARRIAGE EXERCISE ASSEMBLY

RELATED APPLICATION

This is a continuation-in-part of co-pending application Ser. No. 13/229,175 filed Sep. 9, 2011.

BACKGROUND OF THE INVENTION

1. Field of the Invention

The present invention relates generally to the field of exercise equipment. More particularly, the invention relates to an exercise device having what is commonly known as a Smith bar, wherein exercise resistance is provided by a selectable weight stack, rather than free weights.

2. Background

Exercise equipment having a cable and pulley system for lifting a stack of weights has been in use for well over a century. Such equipment comes in a wide variety of designs for performing various exercises. Some have adjustable pulley locations where a handle is attached to a cable for pulling without a defined path of movement. Equipment of this type is often referred to as a functional trainer. One type of such exercise equipment, exemplified, for example, in U.S. Pat. No. 4,402,504, is particularly suited for upper body exercises. This apparatus has an elongated upstanding frame and a carriage that is movable up and down along vertical posts of the frame. The carriage includes one or more pulleys around which a cable is reeved. The cable is further reeved around upper and/or lower pulleys on the frame and is coupled to a source of exercise resistance, such as a plurality of stacked weights. The cable exits the pulley on the carriage and is connected to a handle or similar pulling device. The height of the handle is readily adjustable by moving the carriage on the vertical posts and locking it into position at the selected height. This permits a wide variety of exercises to be performed for exercising muscle groups of the arms and upper body. The amount of exercise resistance is adjusted by selecting more or fewer stacked weights. The range of available exercise resistance is thus determined by the quantity of available weights.

Another type of exercise apparatus is often referred to as a Smith machine. This device consists of a barbell that is fixed within a pair steel rails, which limit the barbell to only vertical movement. Behind each vertical rail is a series of slots or holes on which the barbell can be hooked. This means that the barbell can be secured at any point, unlike an ordinary barbell that must be re-racked after a set of repetitions. This makes a Smith machine safer for those who lift without a spotter, as one only needs to twist the wrist in order to lock the barbell in place in the event that the weight becomes too great. Most Smith machines also incorporate blocks, pegs, or other devices that can be adjusted to automatically stop the barbell at a predetermined minimum height. Unlike a free-weight barbell, the bar on a Smith machine does not move forward, backward or sideways to any appreciable extent. Because lifting on a Smith machine requires less stabilization by the lifter, lifters can usually lift more weight with a Smith machine than with a free-weight barbell. Conventional Smith machines still utilize free weights loaded onto the bar as the source of exercise resistance. Free weights are not only cumbersome to move and store, but also present severe safety hazards.

It would be desirable to include a Smith bar as part of a multi-purpose functional trainer and to utilize a selectable weight stack for exercise resistance with the Smith bar rather than free weights.

SUMMARY OF THE INVENTION

The present invention provides an apparatus for communicating exercise resistance comprising a carriage assembly with at least one upper and at least one lower pulley. First and second cable ends are reeved around the upper and lower pulleys, respectively, and are coupled to a source of selectable exercise resistance. An exercise member is selectively coupled to the two cable ends such that movement of the exercise member away from the carriage is subject to a first exercise resistance when only one of the cable ends is attached and is subject to a second, greater exercise resistance when both cable ends are attached.

In another embodiment, a pulley on a first carriage assembly has a cable end extending from the pulley and another cable end removably attached to the carriage. The cable ends are coupled to a source of selectable exercise resistance. The cable end extending from the pulley may be used with exercise handles or bars. An exercise member is associated with a second carriage assembly above or below the first carriage assembly. The cable end extending from the pulley can attach to the second carriage to provide a first exercise resistance to the exercise member. If more resistance is desired, the cable end attached to the first carriage may be removed from the first carriage and attached to the second carriage, providing a greater resistance.

In another embodiment, an exercise apparatus includes a frame with a pair of vertical guide rods. A carriage is slidably carried on each of the guide rods. Each of the carriages has a locking mechanism to lock the carriage at a selected vertical position and a release to disengage the locking mechanism. A horizontal exercise bar (a Smith bar) is slidably carried on the guide rods. First and second cables are coupled to a selectable exercise resistance, each of the cables having an end selectively coupled to either the respective carriage or to a respective bracket at the end of the Smith bar. This arrangement allows exercises performed with the Smith bar to utilize the selectable exercise resistance rather than free weights. Actuator brackets on the Smith bar are configured to engage respective ones of the carriage releases so as to selectively engage and disengage the locking mechanisms upon axial rotation of the Smith bar or by hand actuated releases on the Smith bar. The actuator brackets on the Smith bar may be further configured to selectively engage and disengage an overhead frame member upon axial rotation of the bar so that the bar can be stored overhead. The exercise apparatus may further include third and fourth cables coupled to the exercise resistance, each of these cables having an end coupled to a pull point on the first and second pulley carriages, respectively. The brackets on the Smith bar are configured for selective attachment of respective ends of the third and fourth cables. Attaching these cable ends to the Smith bar increases the exercise resistance. In this embodiment, the carriages and the horizontal exercise bar may be on the same guide rods or separate guides so long as the cables can attach to both and the actuator brackets on the horizontal exercise bar are configured to engage a respective lock and release on the carriages.

DETAILED DESCRIPTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
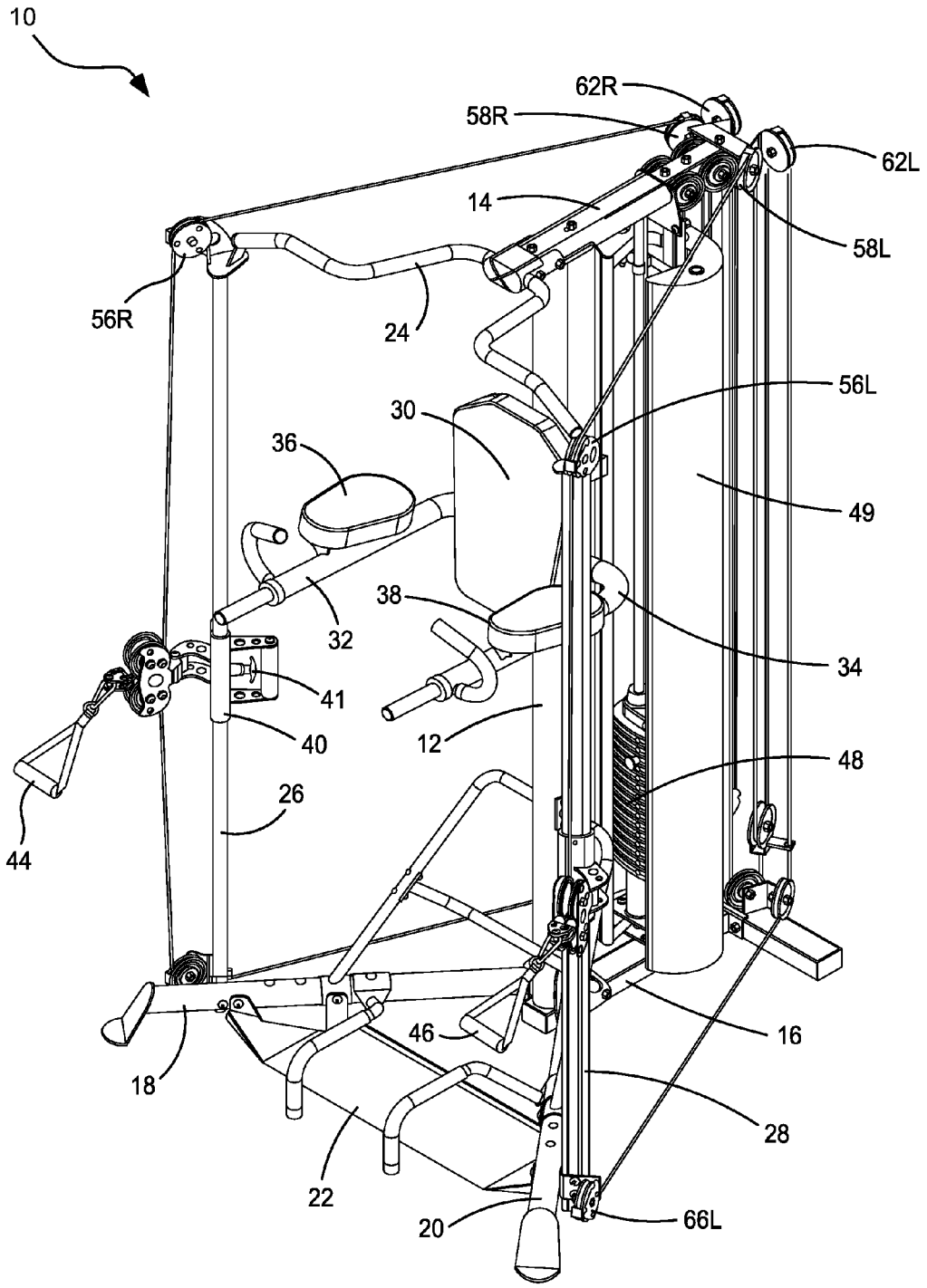
FIG. 1 is a perspective view of an exercise apparatus incorporating an embodiment of the present invention.

Referring first to FIG. 1, exercise apparatus 10 has a frame comprising a central upright 12, top member 14, base member 16 and legs 18 and 20. Footplate 22 is attached between legs 18 and 20. A lat bar assembly 24 is attached to top member 14. Selector tubes 26, 28 are attached between lat bar assembly 24 and leg 18 and between lat bar assembly 24 and leg 20, respectively.

Backrest cushion 30 is attached to central upright 12, as are right handlebar assembly 32 and left handlebar assembly 34. Arm cushions 36, 38 are attached to handlebar assemblies 32, 34, respectively.

Carriage assembly 40 is slidably mounted on selector tube 26 and may be positioned at any desired height by means of pull pin 41 engaging with one of a plurality of holes (not shown) in the selector tube. Carriage assembly 42 is similarly slidably mounted on selector tube 28. A variety of weight resistance exercises may be performed using handles 44 and 46 that are operatively associated with carriage assemblies 40 and 42, respectively, as more fully described below. Exercise resistance is furnished by a selectorized weight stack 48. A shroud 49 may partially enclose weight stack 48.

Figure 2:
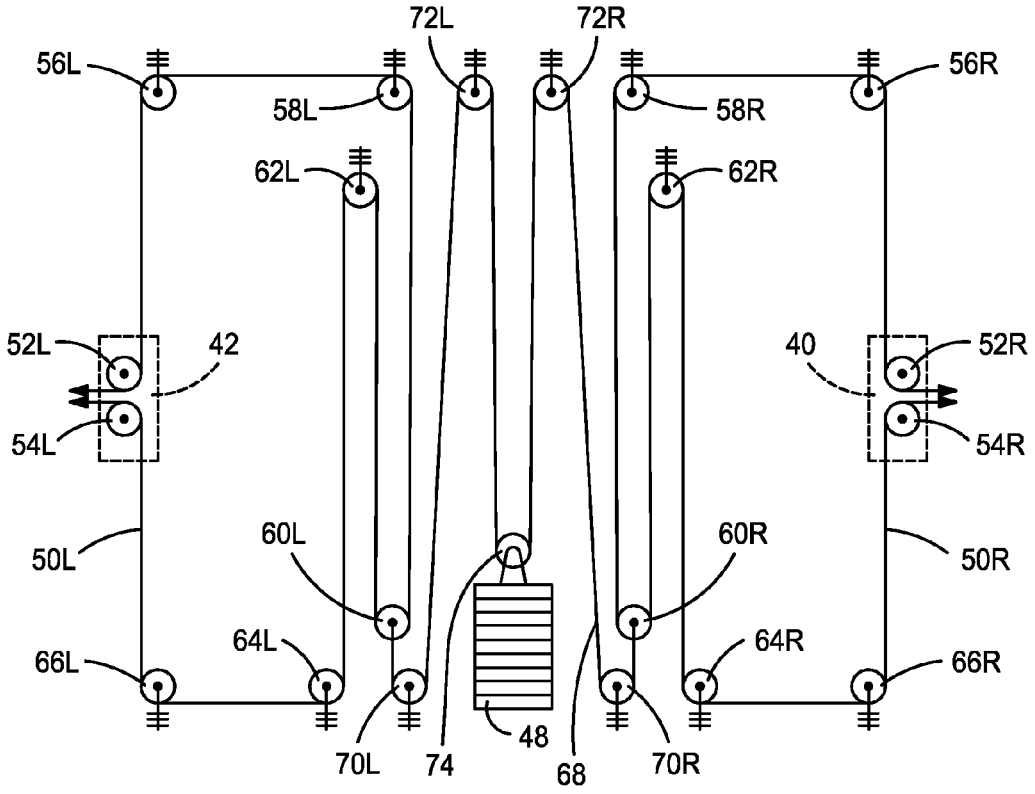
FIG. 2 diagrammatically illustrates the cable and pulley arrangement of the exercise apparatus shown in FIG. 1.

Referring also to FIG. 2, the cable and pulley arrangement of apparatus 10 will be described. Looking to the right side of the figure, pulleys 52R and 54R are rotatably mounted on carriage assembly 40. The two ends of cable 50R are reeved around these two pulleys and are coupled to handle 44, as will be explained below. Continuing up from pulley 52R, cable 50R is reeved around a fixed high pulley 56R and then around another high fixed pulley 58R. Cable 50R then travels downwardly around floating pulley 60R and then upwardly around high fixed pulley 62R. Cable 50R continues down around low fixed pulley 64R and then around low fixed pulley 66R. From there, cable 50R travels upwardly and is reeved around pulley 54R. The cable and pulley arrangement on the left side of the apparatus is a mirror image of that just described.

Cable 68 is attached to floating pulley 60R and travels down and around low fixed pulley 70R. Cable 68 then travels upwardly and around high fixed pulley 72R and then back down and around pulley 74 on the top of weight stack 48. Again, the left side of the apparatus is a mirror image with cable 68 travelling upwardly from pulley 74, around high fixed pulley 72L, then downwardly and around low fixed pulley 70L, and then upwardly to where it is attached to floating pulley 60L.

From FIG. 2, it can be seen that pulling on either end of cable 50R, or on either end of cable 50L, will be resisted by one-fourth of the weight of weight stack 48. Pulling on both ends of cable 50R simultaneously, or on both ends of cable 50L simultaneously, will be resisted by one-half of the weight of weight stack 48.

Figure 3:
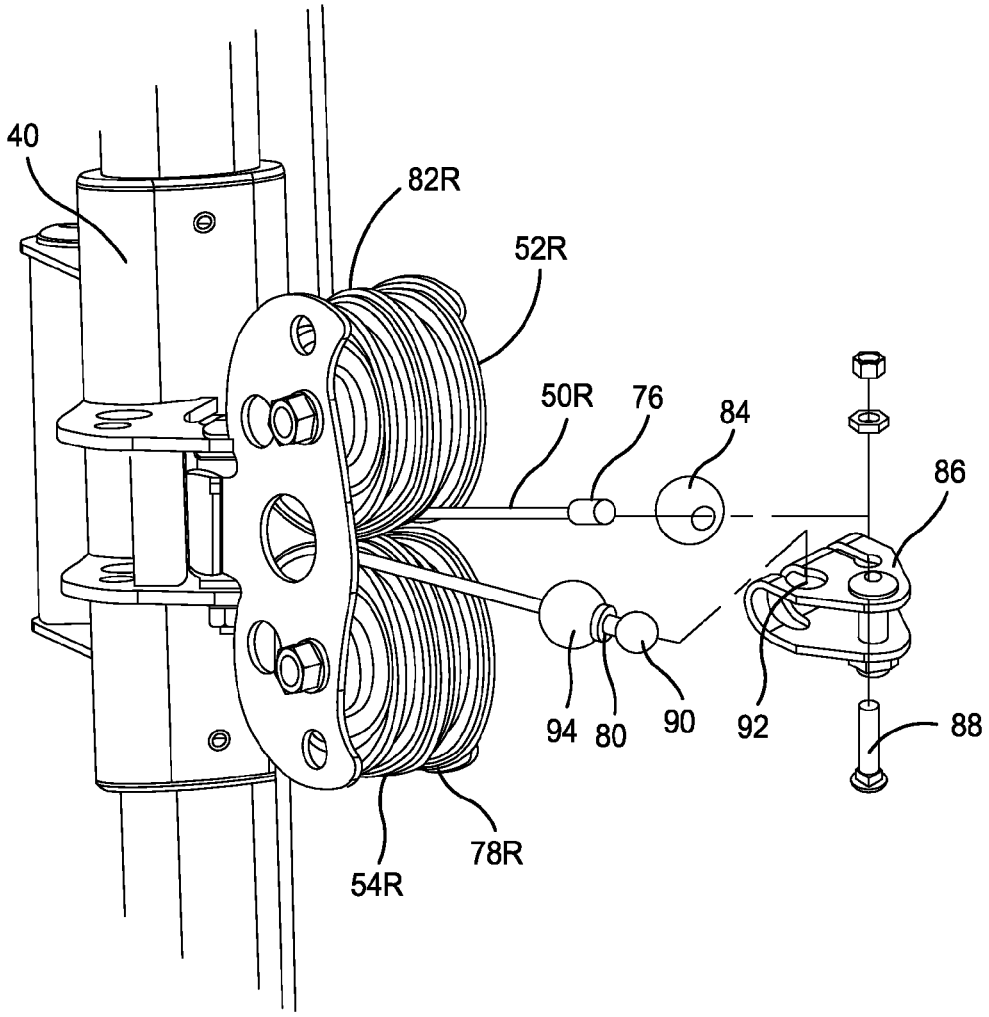
FIG. 3 is a detailed view of a carriage assembly and cable bracket in accordance with an embodiment of the present invention.
Figure 4:
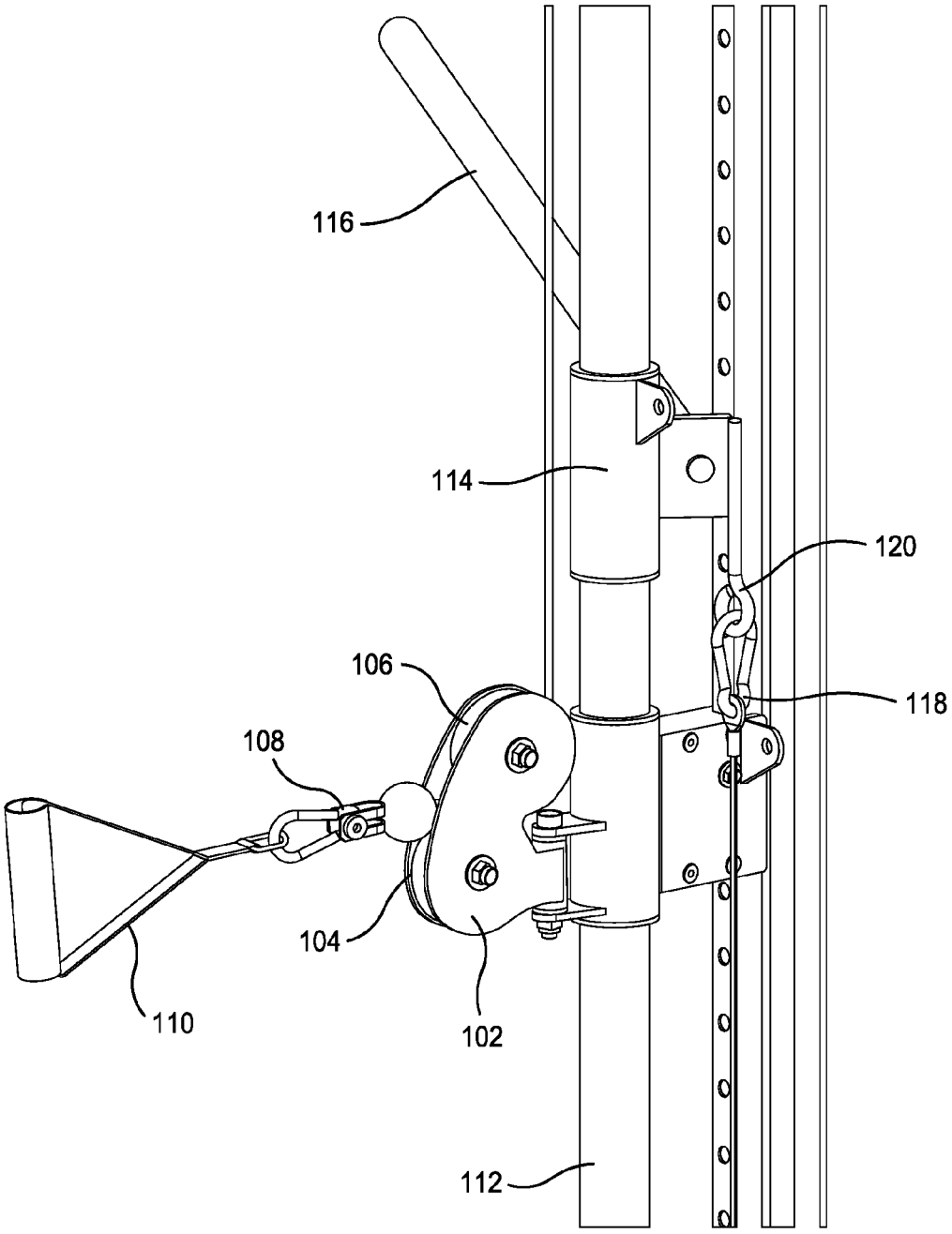
FIG. 4 is a partial perspective view of an exercise apparatus incorporating another embodiment of the present invention.

Details of right side carriage assembly 40 are shown in FIG. 3. It will be understood that left side carriage assembly 42 is a mirror image of assembly 40. A first end 76 of cable 50R exits between a first upper pulley 52R on carriage assembly 40 and a first lower pulley 78R. Similarly, a second end 80 of cable 50R exits between a second upper pulley 82R and a second lower pulley 54R. The first end 76 of cable 50R is inserted through ball stop 84 and is secured to bracket 86 by bolt 88. The second end 80 of cable 50R has a small ball fitting 90 that may be inserted into slot 92 of bracket 86. If the second end 80 is not secured to the bracket 86, it is retained between pulleys 82R and 54R by ball stop 94. Handle 44 (shown in FIG. 1) is coupled to a bracket 86. As previously explained, the first end 76 of cable 50R is secured to bracket 86, so that pulling on the handle will draw out cable 50R from between pulleys 52R and 78R. Pulling in this manner will be resisted by one-quarter of the weight of weight stack 48. If ball 90 is inserted into slot 92, thereby securing the second end 80 of cable 50R to bracket 86, pulling on handle 44 will be resisted by one-half of the weight of weight stack 48. When using one cable end (¼ resistance), the user gets twice the amount of cable travel as when using both cable ends (½ resistance). Functional exercises that simulate body movements of sports activities movements require more travel, whereas traditional training exercises such as lat pull downs require more resistance.

In a variation of the above-described embodiment, the carriage assemblies could each have two pulleys instead of four. In this case, it would be preferred that the two pulleys would be slightly offset from each other axially so that the cable from either pulley would clear the other pulley during use. In this variation, the upper end of the cable would be reeved around the upper pulley and the lower end of the cable would be reeved around the lower pulley. For example, this could be accomplished by modifying carriage assembly 40 shown in FIG. 3 to omit pulleys 78R and 82R. Suitable cable guides or brackets could then be provided to interface with ball sops 84 and 94 to prevent the cable ends from slipping past pulleys 52R and 54R. As in the previously described embodiment, each cable end could be used independently or together to achieve a desired resistance ratio.

Another embodiment of the present invention is illustrated in FIGS. 4-7. A first carriage assembly 102 has a pair of pulleys 104, 106 rotatably mounted thereon. First cable end 108 exits between pulleys 104 and 106 and may be coupled to a handle 110 or a bar (not shown) for performing various exercises. The first carriage assembly 102 is adjustable up and down a slider shaft 112 and is lockable at various positions along the slider shaft. A second carriage assembly 114 is disposed on slider shaft 112 above the first carriage assembly

Figure 5:
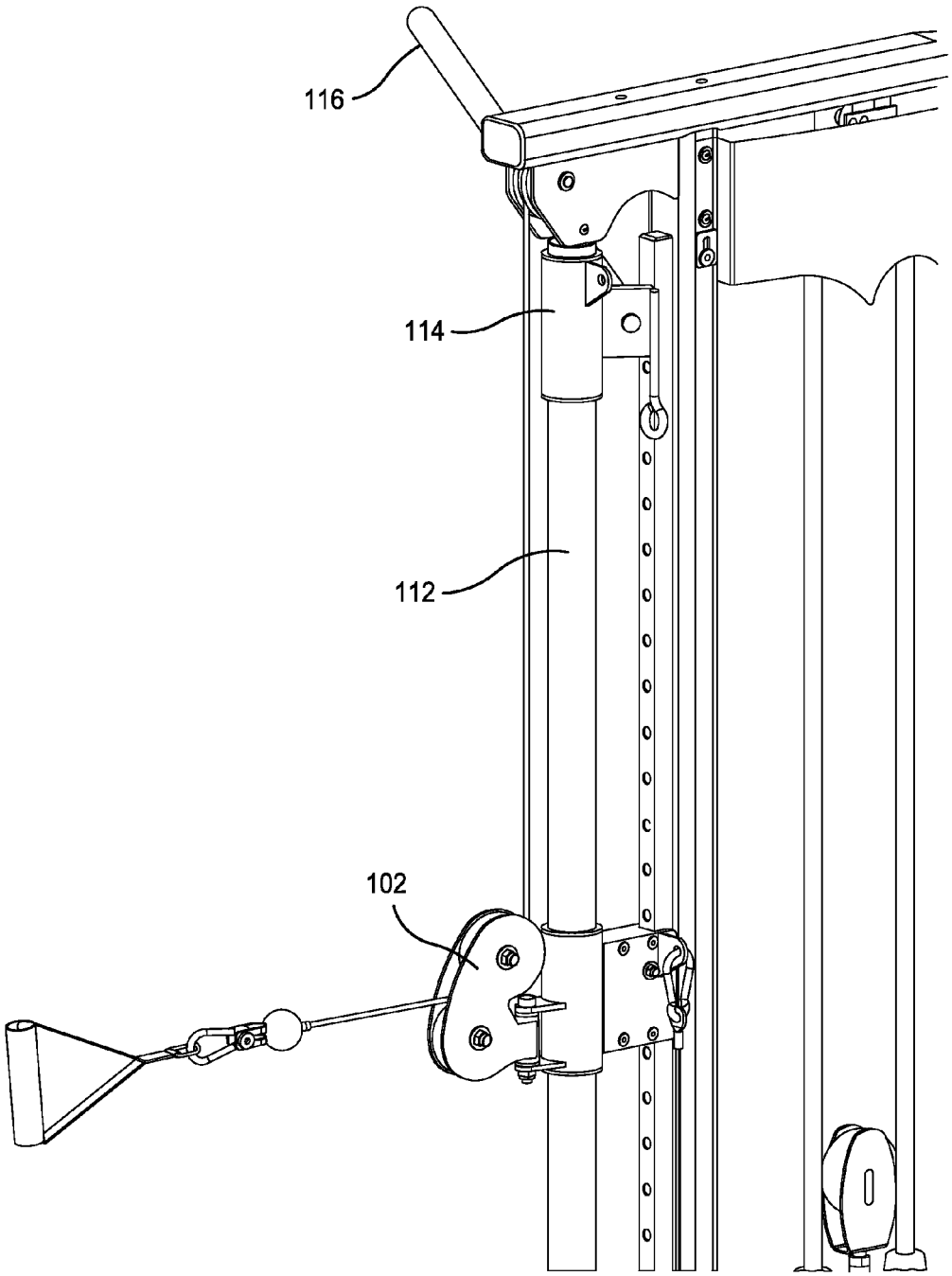
FIG. 5 is another view of the apparatus of FIG. 4.

102. The second carriage assembly 114 has an exercise press bar 116 associated with it. A second cable end 118 is releasably attached to eye 120 on the second carriage assembly 114. The second carriage assembly slides up and down the slider shaft and may be locked in a stowed position at the top of the slider shaft when not in use as shown in FIG. 5. It should be understood that an exercise apparatus incorporating this embodiment of the invention will preferably have two of the previously described arrangements—one each for the left and right sides of the body.

Figure 6:
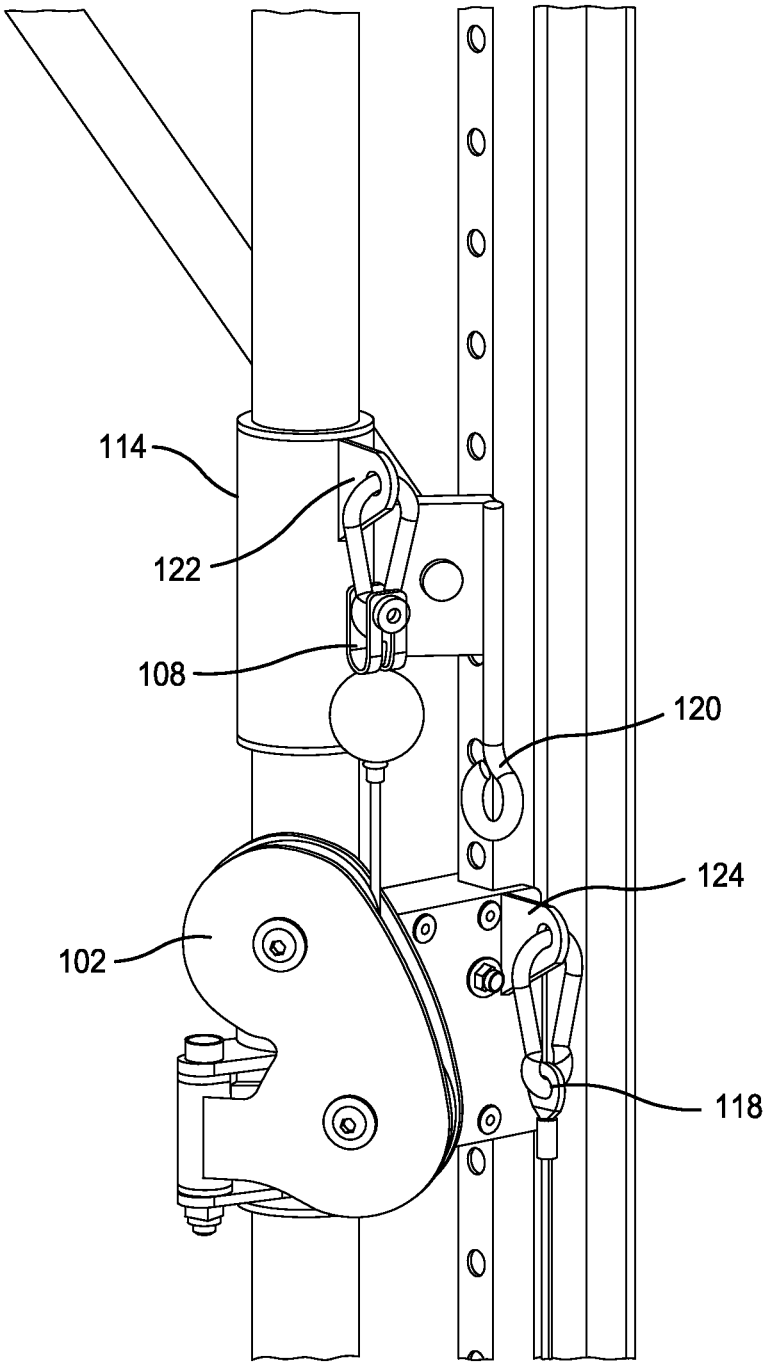
FIG. 6 is another view of the apparatus of FIG. 4.
Figure 7:
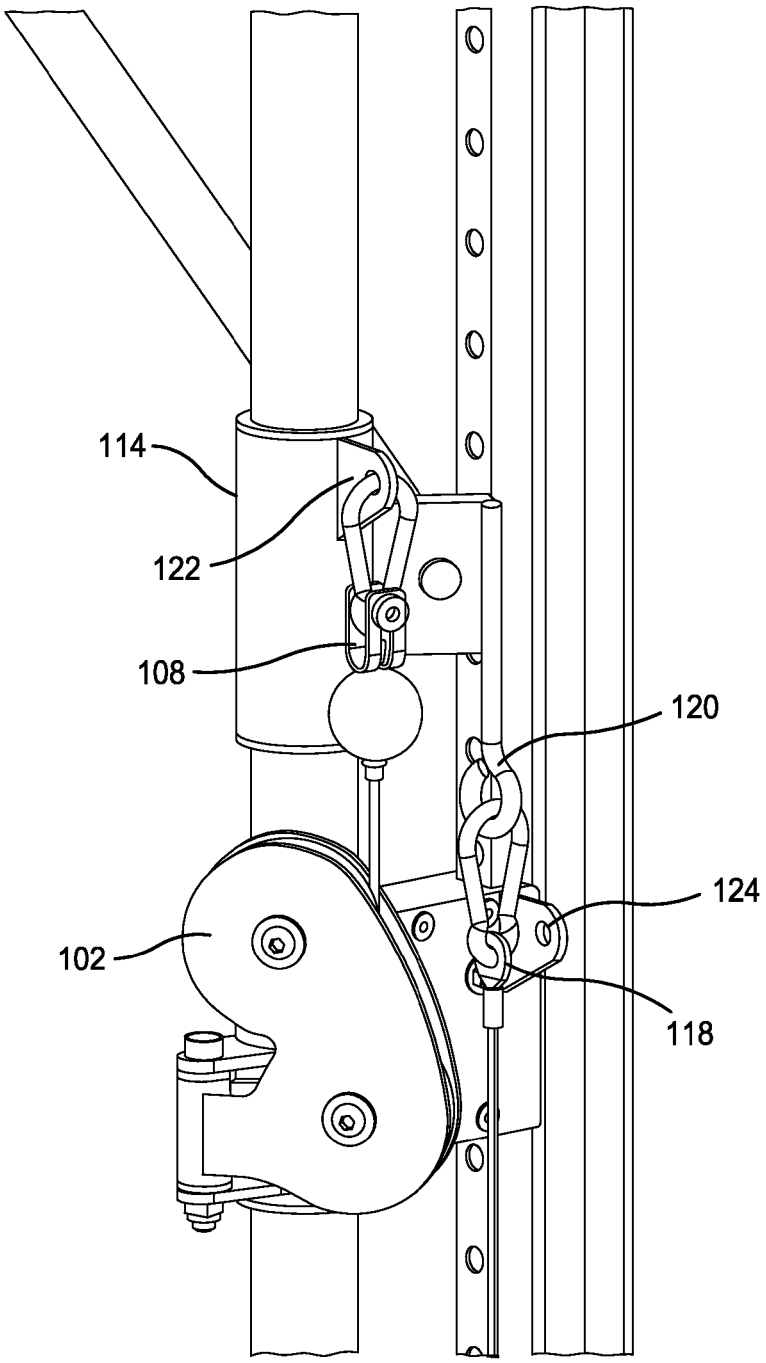
FIG. 7 is another view of the apparatus of FIG. 4.

When using the press bar 116 associated with the second carriage assembly, the second carriage assembly 114 is lowered from its stowed position at the top of the slider shaft and rested on top of the first carriage assembly 102. Attaching the first cable end to eye 122 on the second carriage assembly 114 with the second cable end attached to eye 124 on the first carriage assembly 102 as shown in FIG. 6 provides a first exercise resistance to the press bar. Attaching the second cable end to eye 120 on the second carriage assembly as shown in FIG. 7 provides a second, greater resistance to the press bar.

The configuration shown in FIGS. 4-7 could be reversed with the second carriage assembly located below the first carriage assembly, in which case an exercise bar attached to the second carriage assembly could be used as a pull bar. In this case, the stowed position for the second carriage assembly would be at the bottom of the slider shaft.

Figure 8:
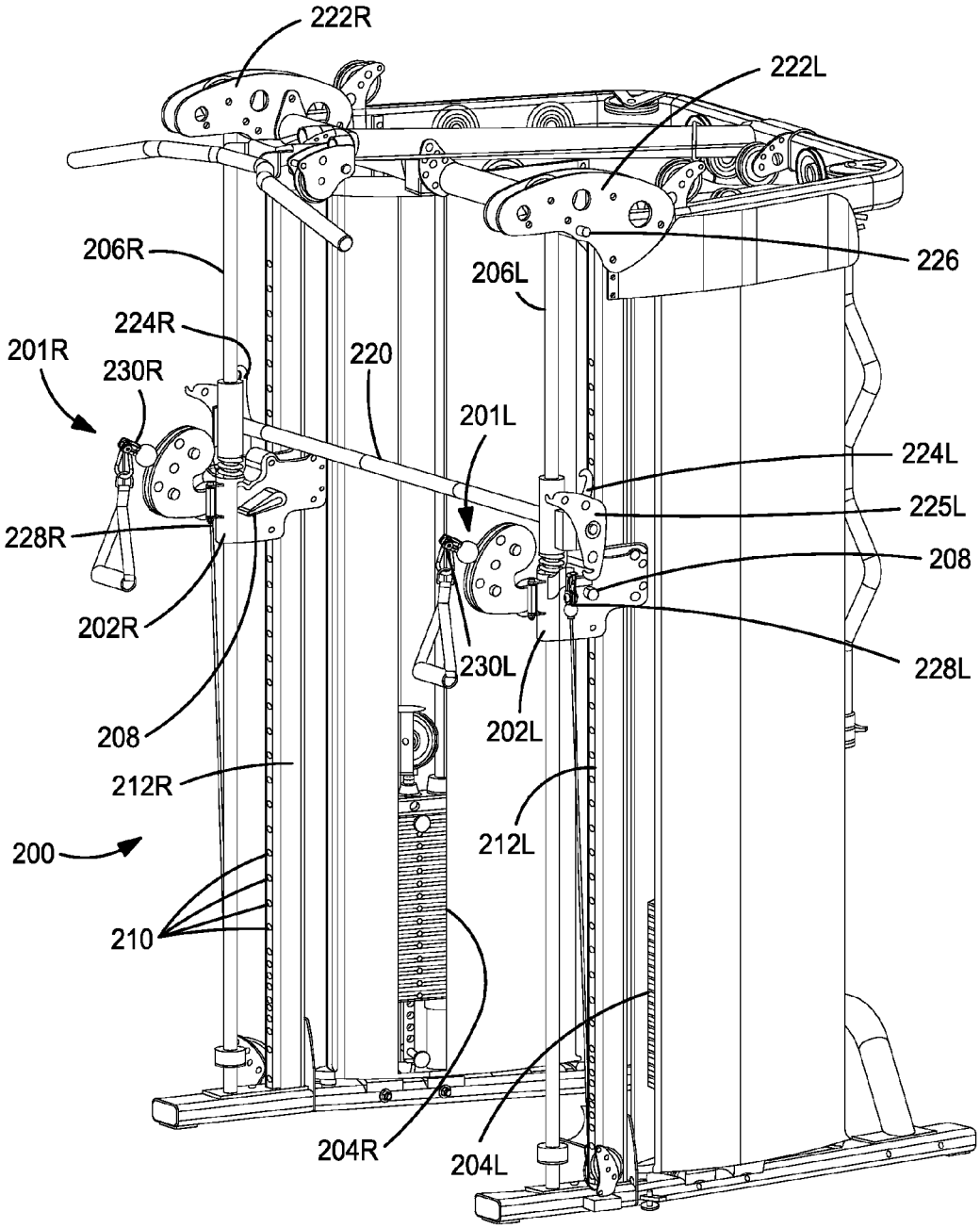
FIG. 8 is a perspective view of an exercise apparatus incorporating another embodiment of the invention.

FIG. 8 illustrates an exercise apparatus 200 in accordance with another embodiment of the invention. Apparatus 200 is a functional trainer with multiple pull points for performing a wide variety of exercises. Two wide, adjustable pull points 201L and 201R, shown here with D-handles, are provided on carriages 202L and 202R, respectively. The pull points are coupled to respective selectable weight stacks 204L and 204R by paired cable and pulley systems similar to those used on apparatus 10 described above. The carriages are vertically slidable on vertical members 212L and 212R, respectively, and include a sleeve that encircles guide rods 206L and 206R, respectively. The carriages may be locked at a desired height by means of respective release levers 208, which couple to pins (not shown) that engage holes 210 in vertical members 212L and 212R.

When carriages 202L and 202R are positioned at a mid height, pull points 201L and 201R may be used to perform such exercises as standing chest presses, incline presses, decline presses, flys and close grip presses. When the carriages are positioned low, near the bottom of guide rods 206L and 206R, pull points 201L and 201R can be used to perform exercises such as shoulder presses, squats, bicep curl, lateral raise and front delt. When the carriages are positioned high on the guide rods, these pull points can be used to perform a wide lat pull down.

Apparatus 200 includes a Smith bar 220. As will be explained more fully below, the Smith bar can be coupled to the weight stacks 204L and 204R to perform exercises commonly performed on conventional Smith machines, such as squats, dead lifts, bench press, incline press, shoulder press, decline press and upright row. Coupling the selectable weight stacks to the Smith bar eliminates the need to use free weights, as is the case with conventional Smith machines.

Figure 9:
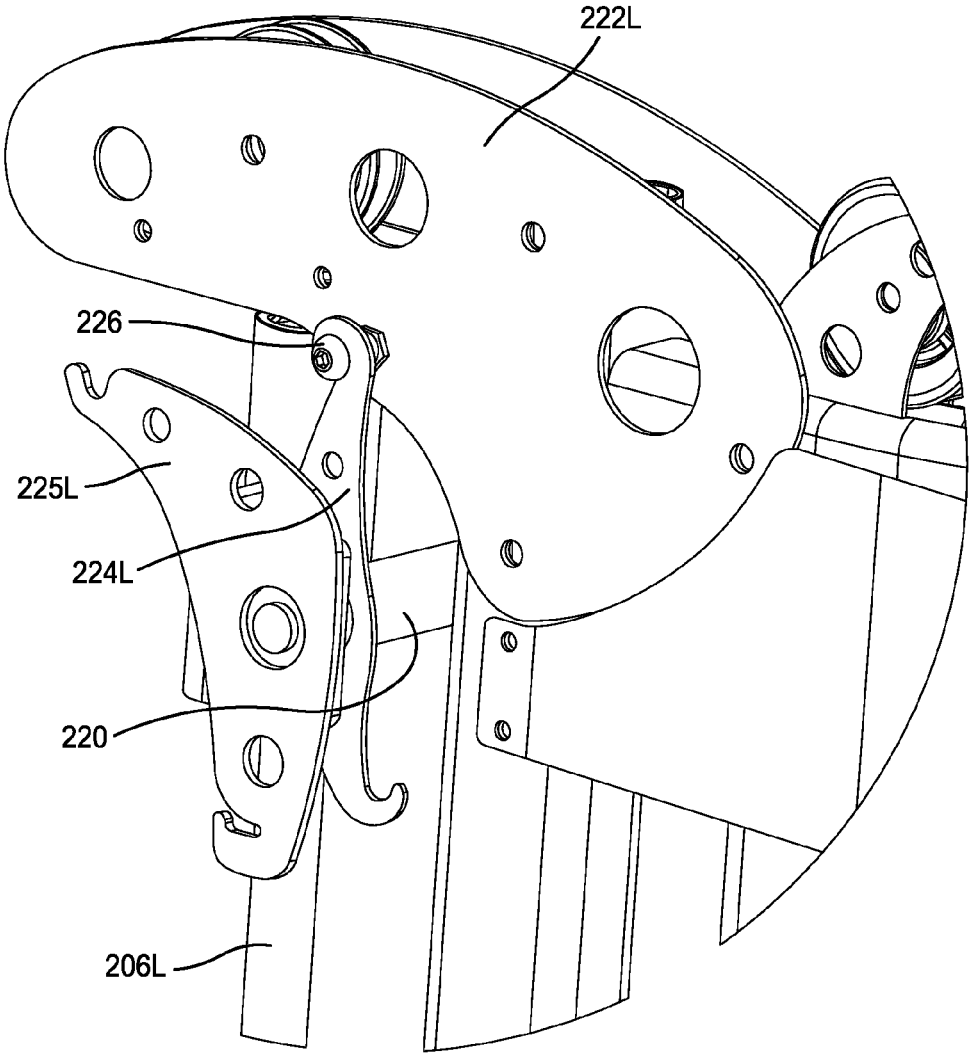
FIG. 9 is a detailed view of the Smith bar of the apparatus of FIG. 8 in a stowed condition.
Figure 10:
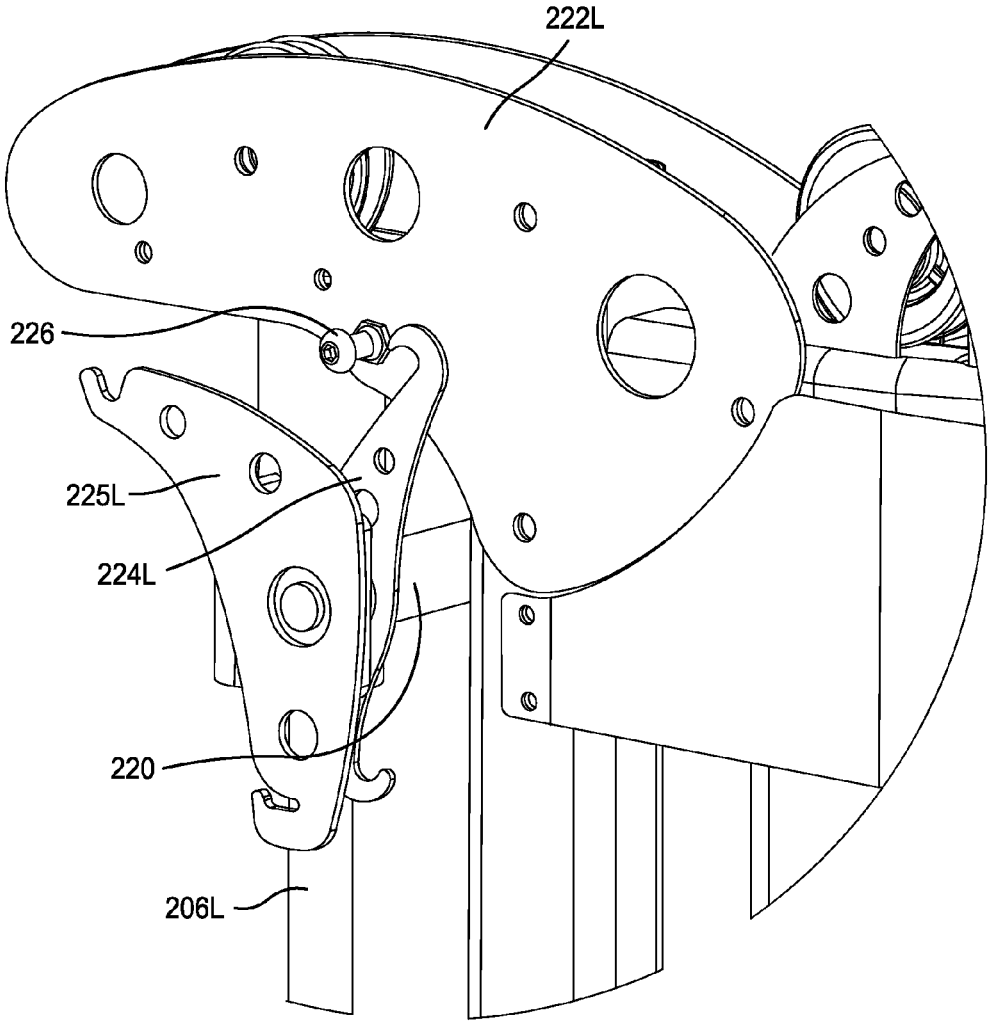
FIG. 10 is a detailed view of the Smith bar of the apparatus of FIG. 8 after being released from a stowed condition.

When not in use, the Smith bar 220 is stowed on overhead pulley support members 222L and 222R by means of secondary brackets 224L and 224R, each of which comprises a catch to engage respective pins 226 on the pulley support members as seen in FIG. 9. An additional safety lock can be swiveled under the Smith bar to prevent falling if the Smith bar is accidentally rotated. The Smith bar 220 rotates axially just like a conventional Smith bar and may be removed from its stowed position by rotating the bar to disengage the secondary brackets from pins 226 as seen in FIG. 10.

Figure 11:
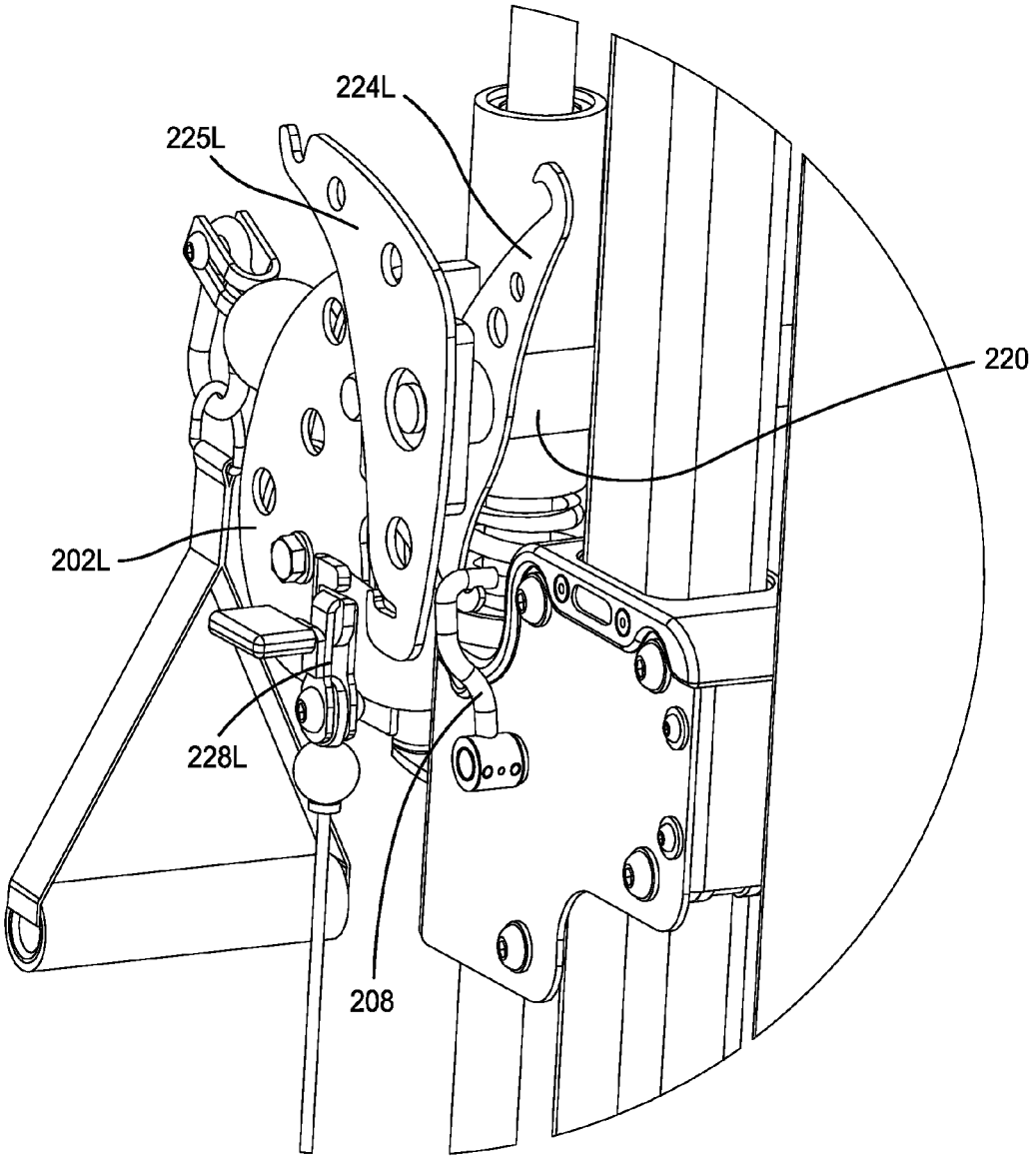
FIG. 11 is a detailed view of exercise resistance being applied to a movable carriage on the apparatus of FIG. 8.
Figure 12:
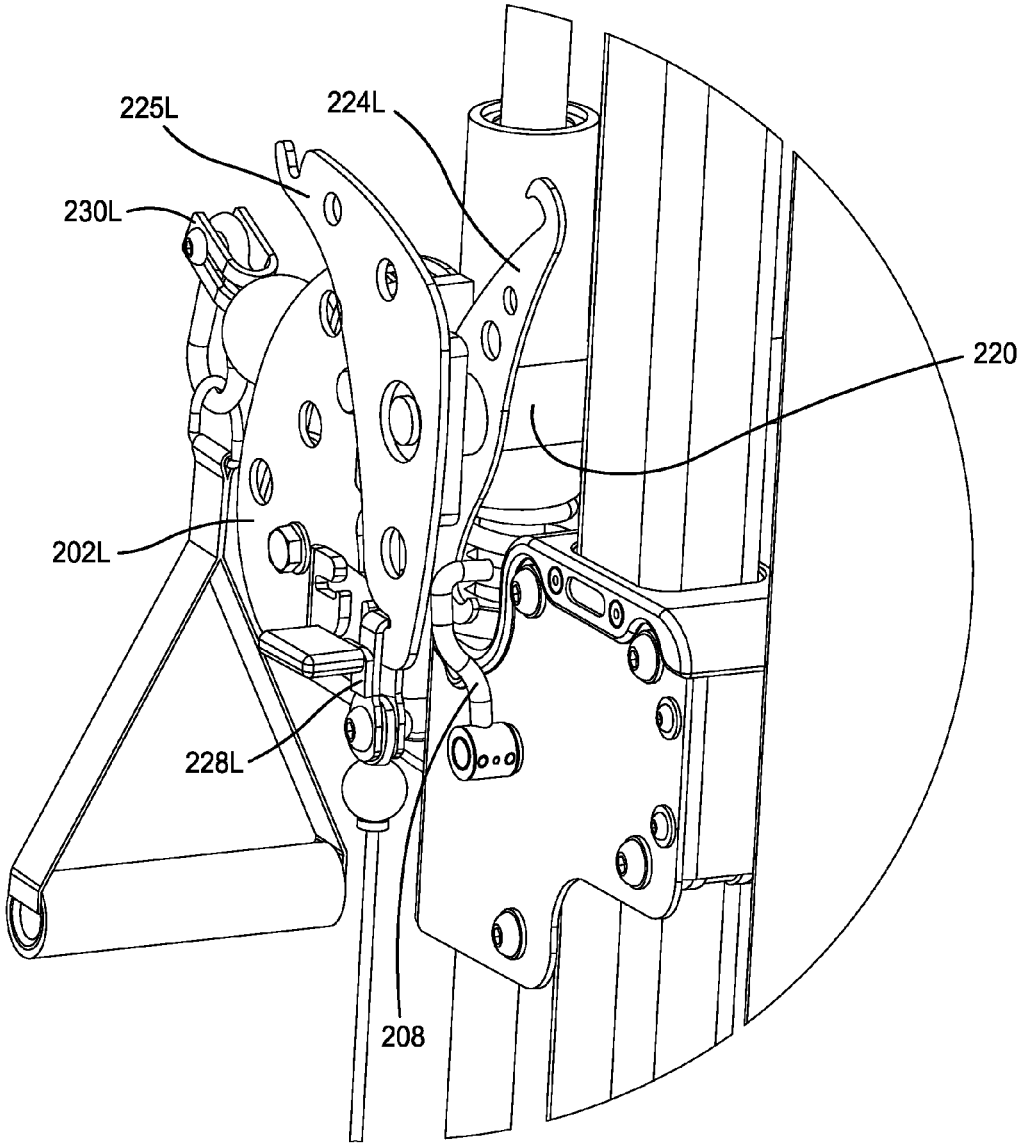
FIG. 12 is a detailed view of exercise resistance being applied to the Smith bar of the apparatus of FIG. 8.

To perform exercises with the Smith bar, carriages 202L and 202R are first brought to a mid position at equal heights on guide rods 206L and 206R. The Smith bar is then removed from its stowed position and brought down to the carriages. Cable ends 228L and 228R, which are normally hooked onto the respective carriages as seen in FIG. 11, are unhooked from the carriages and slid over to hook onto the Smith bar end brackets 225L and 225R as seen in FIG. 12, thereby coupling the Smith bar to the weight stacks. Secondary brackets 224L and 224R attached to the Smith bar function as release actuators to engage the carriage release levers 208 so that rotating the bar allows the carriages to move up and down on the guide rods using the Smith bar to move them. This release, move and lock feature allows the carriages to work as a safety when performing exercises such as squats. The bar and carriages are first lowered to a desired safety position. Then the bar is rotated to release the levers 208 and lock the carriages in place. The selected exercise weights remain attached to the bar by virtue of the cable ends 228L and 228R being hooked onto the bar end brackets 225L and 225R. When done exercising, the bar is brought back down to pick up the carriages. The exerciser then stands up and allows the carriages to lock into place. The Smith bar may then be left with the carriages or brought to the top and stored on pins 226. An additional safety lock may be engaged with the Smith bar when stored.

Figure 13:
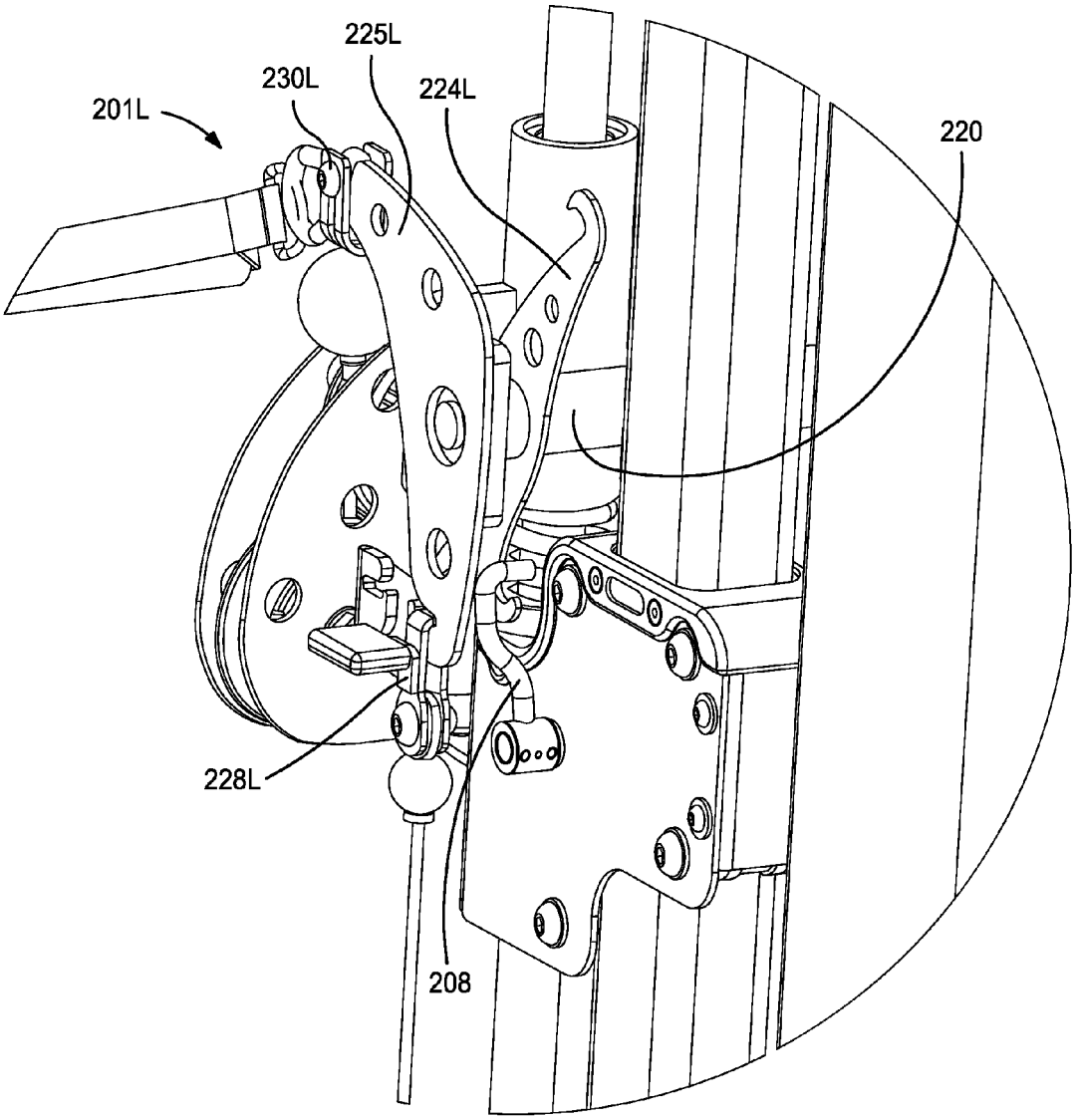
FIG. 13 is a detailed view of increased exercise resistance being applied to the Smith bar of the apparatus of FIG. 8.

As with the exercise apparatuses described above in connection with FIGS. 1-7, apparatus 200 incorporates a weight multiplier for doubling the exercise resistance applied to Smith bar 220. To engage the weight multiplier, the cable ends 230L and 230R of pull points 201L and 201R are attached to bar end brackets 225L and 225R, respectively, as seen in FIG. 13.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An exercise apparatus comprising:

a frame;

first and second guides coupled to the frame;

first and second carriages associated with respective ones of the guides, each of the carriages having a locking mechanism to lock the carriage at a selected vertical position and a release to disengage the locking mechanism;

a generally horizontal exercise bar slidably carried on the guides, the exercise bar having first and second cable engagements at opposing ends;

a selectable exercise resistance;

first and second cable ends coupled to the exercise resistance, each of the first and second cable ends selectively coupled to at least one of the respective carriage or the respective exercise bar cable engagement;

first and second release actuators at opposing ends of the exercise bar;

wherein the exercise bar release actuators are configured to engage respective ones of the carriage releases so as to selectively engage and disengage the respective locking mechanism; and wherein the exercise bar includes a catch configured to selectively engage and disengage an overhead frame member upon axial rotation of the exercise bar.

2. The exercise apparatus of claim 1 further comprising a third cable end coupled to the exercise resistance and coupled to a pull point on the first carriage and a fourth cable end coupled to the exercise resistance and coupled to a pull point on the second carriage, wherein the exercise bar cable engagements are configured for selective attachment of the third and fourth cable ends, whereby such attachment increases the exercise resistance communicated to the exercise bar.

3. The exercise apparatus of claim 2 wherein attachment of the third and fourth cable ends to the exercise bar brackets doubles the exercise resistance communicated to the exercise bar.

4. The exercise apparatus of claim 1 further comprising third and fourth cable ends coupled to the exercise resistance, each of the third and fourth cable ends selectively coupled to either the respective carriage or the respective exercise bar cable engagement.

5. The exercise apparatus of claim 4 wherein when the first, second, third and fourth cable ends are coupled to the respective exercise bar cable engagements, the exercise resistance is greater than when only the first and second cable ends are coupled to the respective exercise bar cable engagements.

6. The exercise apparatus of claim 1 wherein the exercise bar release actuators are actuated by axial rotation of the exercise bar.

7. The exercise apparatus of claim 1 wherein axial rotation of the exercise bar disengages the respective locking mechanism and holds the carriages with the exercise bar for vertical adjustment.

8. The exercise apparatus of claim 1 wherein the carriages are configured as rest stops for the exercise bar.

9. An exercise apparatus comprising:

a frame;

a generally horizontal exercise bar coupled to the frame for vertical movement, the exercise bar having first and second cable engagements at opposing ends;

first and second carriages coupled to the frame for vertical adjustment, each of the carriages having a locking mechanism to lock the carriage at a selected vertical position and a release to disengage the locking mechanism;

a selectable exercise resistance;

first and second cable ends coupled to the exercise resistance, each of the first and second cable ends selectively coupled to at least one of the respective carriage or the respective exercise bar cable engagement;

a user actuated release actuator coupled to the exercise bar;

wherein the exercise bar release actuator is configured to engage the carriage releases so as to selectively engage and disengage the respective locking mechanism upon actuation by the user;

wherein the exercise bar includes a catch configured to selectively engage and disengage an overhead frame member.

10. The exercise apparatus of claim 9 further comprising third and fourth cable ends coupled to the exercise resistance, each of the third and fourth cable ends selectively coupled to at least one of the respective carriage or the respective exercise bar cable engagement.

11. The exercise apparatus of claim 10 wherein when the first, second, third and fourth cable ends are coupled to the respective exercise bar cable engagements, the exercise resistance is greater than when only the first and second cable ends are coupled to the respective exercise bar cable engagements.

12. The exercise apparatus of claim 9 wherein actuation of the release actuators disengages the respective locking mechanism and holds the carriage with the exercise bar for vertical adjustment.

13. The exercise apparatus of claim 9 wherein the exercise bar has a rest position on the carriages.

14. The exercise apparatus of claim 9 wherein the exercise bar release actuator is actuated by axial rotation of the exercise bar.

15. An exercise apparatus comprising:

a frame;

first and second guide rods coupled to the frame;

first and second pulley carriages slidably adjustable along respective ones of the guide rods, each of the carriages having a locking mechanism to lock the carriage at a selected vertical position along the frame and a release to disengage the locking mechanism;

a generally horizontal exercise bar slidably carried on the guide rods, the exercise bar having first and second brackets at opposing ends, the exercise bar further having first and second release actuators at opposing ends;

a selectable exercise resistance;

a cable system coupled to the exercise resistance, the cable system having first and second cable ends, each cable end selectively coupled to at least one of a respective carriage or a respective exercise bar bracket;

wherein the exercise bar release actuators are configured to engage respective ones of the carriage releases so as to selectively en a e and disengage the respective locking mechanism upon axial rotation of the exercise bar; and wherein the exercise bar includes a catch configured to selectively engage and disengage an overhead frame member upon axial rotation of the exercise bar.

16. The exercise apparatus of claim 15 further comprising third and fourth cable ends coupled to the exercise resistance, each of the third and fourth cable ends selectively coupled to at least one of the respective carriage or the respective exercise bar bracket.

17. The exercise apparatus of claim 16 wherein when the first, second, third and fourth cable ends are coupled to the respective exercise bar brackets, the exercise resistance is greater than when only the first and second cable ends are coupled to the respective exercise bar brackets.

* * * * *